United States Patent [19]

Worth et al.

[11] 4,348,073

[45] Sep. 7, 1982

[54] FRANGIBLE POLARIZING RIB FOR MULTIPLE CONTACT HEADER

[75] Inventors: Sidney V. Worth, Flourtown; Keith D. Nelson, Willow Grove, both of Pa.

[73] Assignee: Continental-Wirt Electronics Corp., Warminster, Pa.

[21] Appl. No.: 163,740

[22] Filed: Jun. 27, 1980

[51] Int. Cl.[3] ..... H01R 13/645

[52] U.S. Cl. ..... 339/186 M

[58] Field of Search ..... 339/184 R, 184 M, 186 R, 339/186 M, 176 R, 174, 17 F, 17 L, 65, 66 M

[56] References Cited

U.S. PATENT DOCUMENTS 3,200,361 8/1965 Schwartz et al. ..... 339/17 LC
3,518,620 6/1970 Susley et al. ..... 339/184 M

FOREIGN PATENT DOCUMENTS 2743033 3/1979 Fed. Rep. of Germany ... 339/186 M
2035721 6/1980 United Kingdom ..... 339/186 M

*Primary Examiner*—Eugene F. Desmond
*Attorney, Agent, or Firm*—Ostrolenk, Faber, Gerb & Soffen

[57] ABSTRACT

A multiple contact connector header has a frangible section carrying a rib which extends laterally from a wall of the header to interfere with the body of a socket which engages the header unless the socket has a groove to receive the rib, thereby to polarize the socket and header combination. The rib can be removed from the header by breaking away the frangible section to enable the header to be used with a socket not containing polarizing grooves.

9 Claims, 9 Drawing Figures

FRANGIBLE POLARIZING RIB FOR MULTIPLE CONTACT HEADER

BACKGROUND OF THE INVENTION

This invention relates to multiple contact connectors, and more specifically relates to a novel structure for polarizing cooperating headers and sockets to prevent their inadvertent connection with an improper angular relationship relative to one another.

Multiple contact connectors are well known in the art and consist of header and socket combinations which interconnect with one another to enable connection of multiple wires to corresponding terminals.

In a common arrangement, the socket consists of an elongated insulation body having a plurality of contact receiving elements extending along one or more parallel lines, with each of the contact elements having extensions adapted to pierce a flat, multiple wire cable so that each contact is connected to a corresponding conductor in the multiple wire cable. Electrical connection can be made to the individual contacts of the socket by a header which is an elongated insulation body having parallel extending contact pins insulated from one another and which make sliding contact with associated contacts in the socket. The opposite ends of the contact pins in the header can then be connected to any suitable electrical circuit.

Since the contact sections of the headers and sockets are functionally symmetric, it is possible to connect the headers and sockets with one of two angular orientations relative to one another. It is, therefore, desirable to polarize the sockets and headers to ensure that they will be connected in only one of the two possible angular arrangements relative to one another.

Polarizing arrangements for polarizing the headers and sockets are well known. For example, polarizing keys are provided which can be inserted into one contact position of a socket. The corresponding pin in the header is then cut off. Thus, if one tries to assemble the header and socket with the wrong angular relationship, the connection will be prevented because an extending pin will not be able to enter the blocked contact region of the socket. This system has the disadvantage of losing a contact position in the header arrangement.

Another known polarizing arrangement uses a polarizing tab on one end of a female socket which can mate only with one side of the corresponding header. This arrangement permits polarization without any contact loss which is required when using polarizing keys which are inserted in a contact position in the socket.

A further known method uses a protruding rib molded into the center of one side of a socket housing. This rib is to enter a cooperating slot in the header, but the arrangement allows mating of the socket and header if they are rotated by 180° from the preferred position.

Another known polarizing system which is coming into common use requires a groove in the outer side wall of a socket and a corresponding rib in the side wall of the cooperating header. The rib in the header will enter the groove in the socket only when the socket and header are properly angularly related to one another before their connection. If this polarizing rib is permanently attached to a header body, it is impossible to use the header with any socket other than one having the necessary polarizing groove. Thus, a large number of sockets, now installed in electrical equipment and of an unpolarized variety, cannot accept headers adapted with the permanent polarizing rib. To avoid this problem, separate polarizing ribs are provided which can be fixed to conventional, unpolarized headers. Thus, the key is added only if the header is to be used with a polarized socket. However, these polarizing keys are separate, loose clips that are costly, can be easily lost or broken, and can be accidentally dislocated relative to the header body.

BRIEF DESCRIPTION OF THE PRESENT INVENTION

In accordance with the present invention, an integral polarizing rib on the header body is placed within a frangible section of the header which is securely integrally fixed to the header and can be relatively easily broken away from the header by an intentional removal operation. Consequently, the header is normally used with sockets which have polarizing grooves. However, if it is desired to use the header with a socket without polarizing the grooves, any simple tool enables the removal of the rib from the header by breaking away the frangible section. The frangible section may be formed by fairly deep slots which encircle the rib, with or without a series of perforated holes extending through the shallow slot material which encloses the rib area. Preferably, the means for forming the frangible section will result in a relatively clean fracture in the header back when the rib is removed.

DETAILED DESCRIPTION OF THE DRAWINGS

Figure 1:
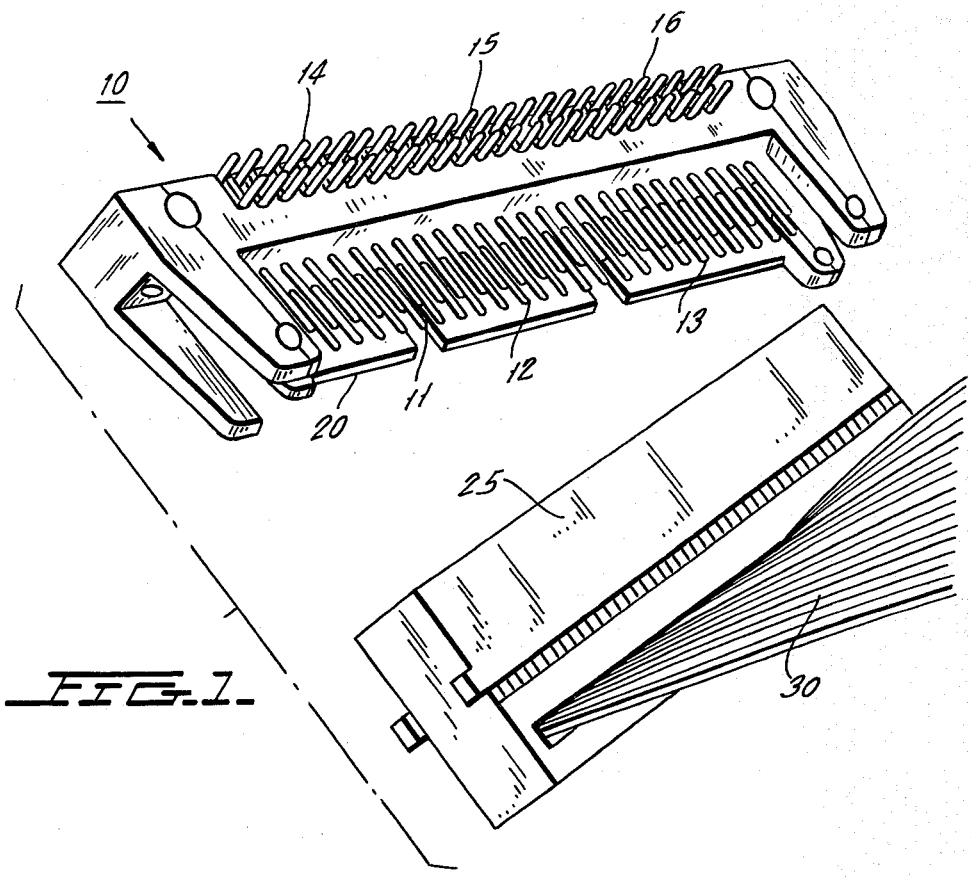
FIG. 1 shows, in exploded perspective view, a standard header and socket therefor before they are engaged with one another.
Figure 3:
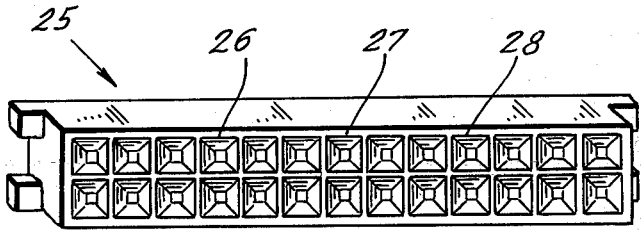
FIG. 3 is a top perspective view of the socket of FIGS. 1 and 2 and illustrates the contact-receiving surface of the socket.
Figure 2:
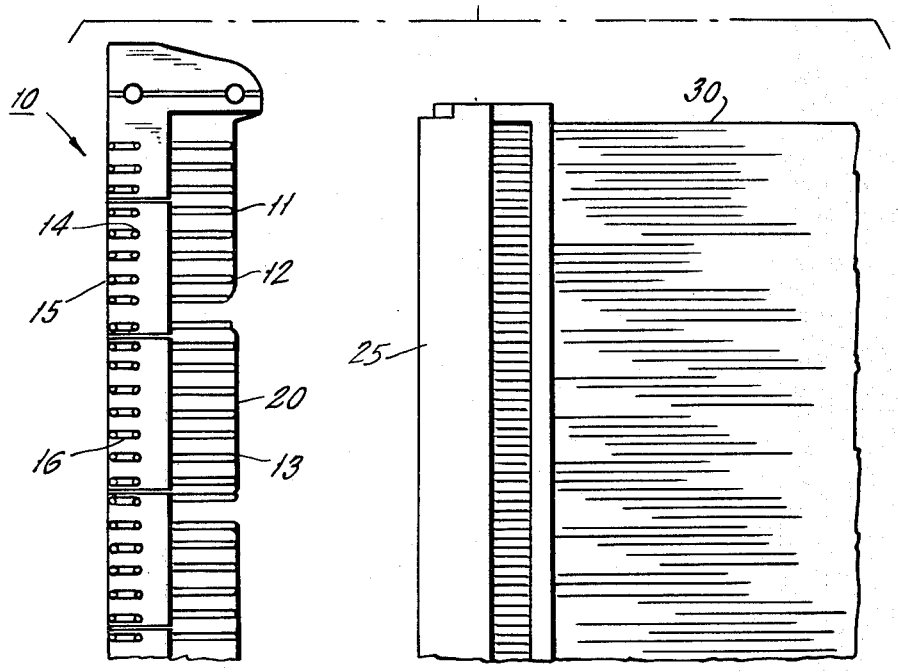
FIG. 2 is a plan view of the header and socket of FIG. 1.
Figure 4:
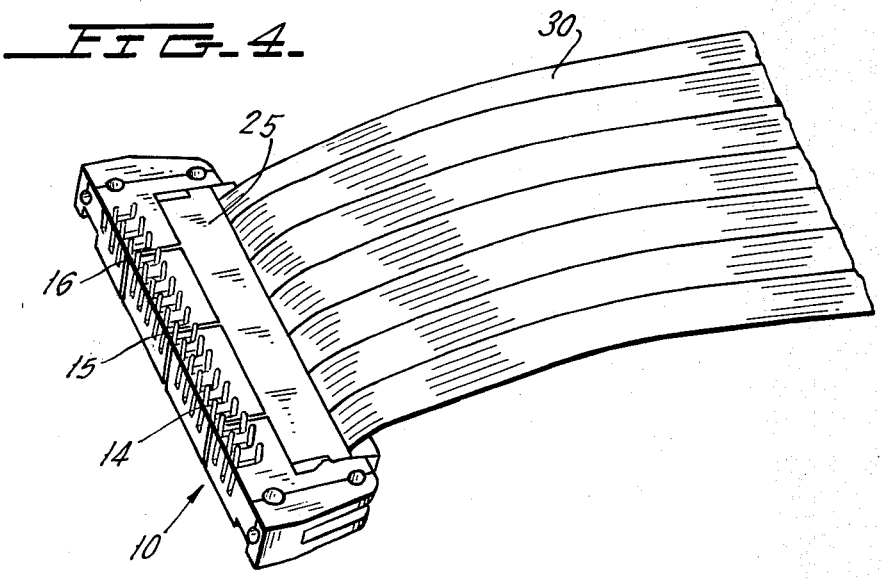
FIG. 4 is a perspective view of the header and socket of FIG. 1 after the two are connected together.

FIGS. 1 through 4 show a standard header and socket arrangement which can be polarized in accordance with the invention as will be later described. The header 10 is shown in FIGS. 1, 2 and 4 and consists of a molded insulation body which contains a plurality of extending contact pins, such as the contact pins 11, 12 and 13 in FIGS. 1 and 2 which have corresponding terminal ends such as the terminal ends 14, 15 and 16. Note that the contact pins are parallel to one another and may be arranged in two parallel rows as seen in FIG. 1. The header configuration 10 is conventionally provided with a header back 20 which is an insulation wall. A parallel spaced insulation wall could also be provided.

The header 10 cooperates with a socket 25, where the socket 25 consists of a molded base having a plurality of contacts contained in respective socket openings, such as the socket openings 26, 27 and 28 in FIG. 3, where one socket opening will be provided for each of the respective contact pins of the header 10.

The socket 25 is then provided with suitable contact connection means for causing electrical connection between each individual wire of a flat cable 30 to a respective one of the contacts within the socket. By this means, it becomes possible to electrically connect each of the individual wires 30 to a respective terminal, such as one of the terminals 14, 15 or 16 or any of the other terminals of the contact pins of the headers. These contact pin terminal ends can then be suitably connected to any desired electrical circuit.

In order to make electrical connection between the header and socket, one simply forces the contact pins, such as pins 11, 12 and 13, into their respective contact openings in the socket until the header and socket telescopically engage one another, as shown in FIG. 4. In this position, the back wall 20 of the header first clears the side of socket 25 and telescopes over the side of the socket.

Figure 5:
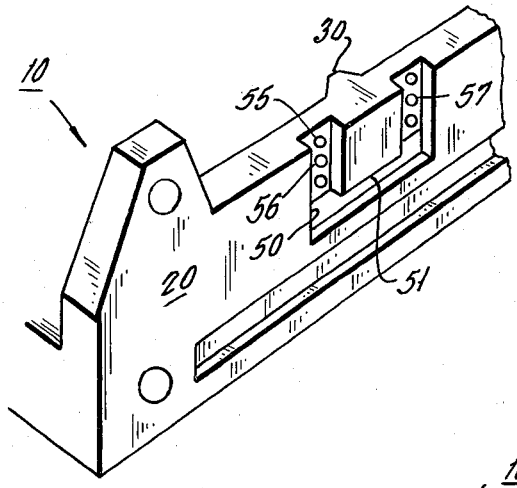
FIG. 5 is a perspective view greatly enlarged of a portion of the header of FIGS. 1, 2 and 4 when adapted with a frangible polarizing rib.
Figure 6:
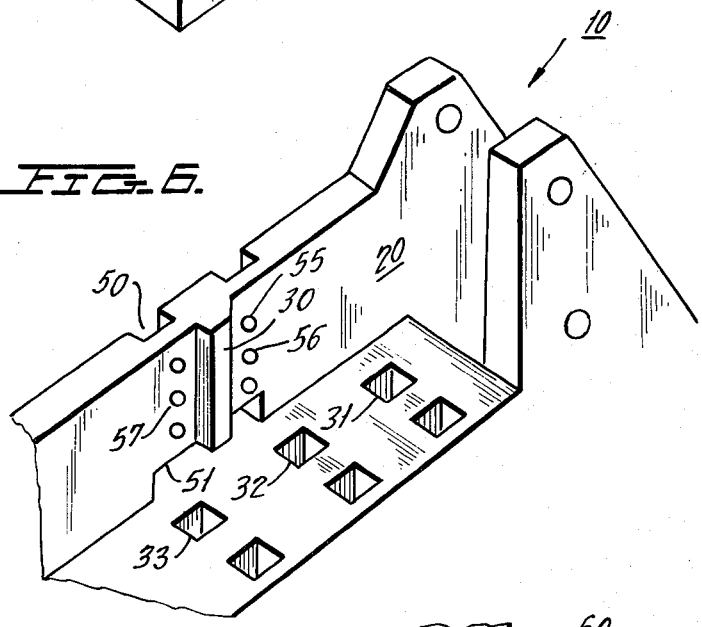
FIG. 6 is a further view from a different perspective than that of FIG. 5 of a polarizing rib contained within a frangible section.
Figure 7:
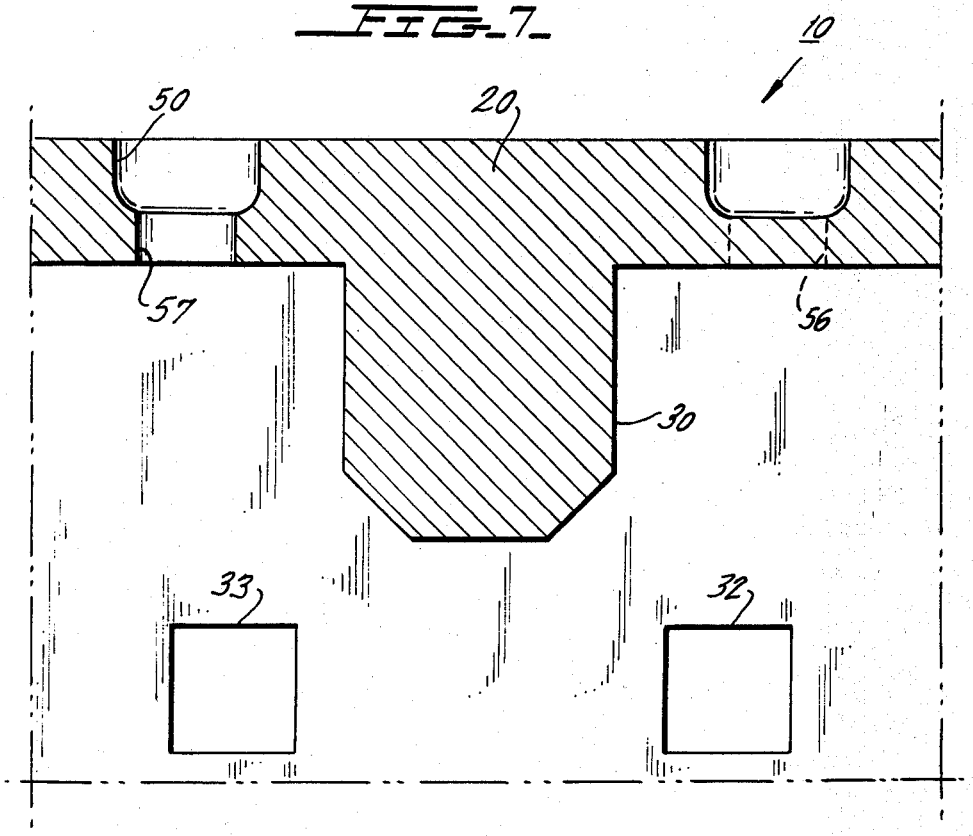
FIG. 7 is a partial cross-sectional view through the header wall in FIGS. 5 and 6 which contains the polarizing rib.

As best shown in FIGS. 5, 6 and 7, polarizing ribs are formed in the back wall 20 of the header 10. The ribs extend parallel to the contact pins and are on the surface of wall 20 which faces the contact pins. FIG. 5 shows one rib 30 which is molded integrally with the back 20 and the main body of the header 10. Note that FIGS. 5, 6 and 7 do not show the extending pins but show the openings, such as openings 31, 32 and 33 which are square openings 0.025 inch on a side which receive respective contact pins. Two or more ribs 30 can be placed in the back wall 20 if desired.

Figure 8:
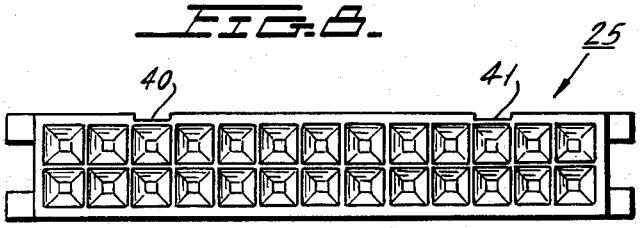
FIG. 8 is a view similar to FIG. 3 of the socket containing two polarizing grooves in the insulation wall thereof for receiving the header of FIGS. 5, 6 and 7 in polarizing relationship.

Ribs 30 then mate with polarizing grooves, such as the grooves 40 and 41 in the socket 25 as shown in FIG. 8. The ribs 30 in the header 10 will prevent connection of the header 10 and socket 25 unless the ribs 30 are oriented on the side of socket 25 containing the grooves 40 and 41, thereby polarizing the header and sockets.

Since it is possible that one may wish to use header 10 with a socket without polarizing grooves or with some different polarizing structure, in accordance with the present invention, the ribs 30 are formed in integral but frangible sections in back wall 20 and can be easily broken out of the wall 20 by the intentional use of a simple tool. Thus, as best shown in FIGS. 5, 6 and 7, a frangible section is defined by the U-shaped slot 50 which encloses the rib 20 and extends to an opening or channel 51 below the bottom end of rib 20. By enclosing the rib 20 with slot 51, the opening formed will have clean, well-defined edges. The bottom of slot 50 may also contain a plurality of perforations or through-openings, such as the openings 55, 56 and 57 to make it easier to break out the frangible section containing the rib 20 when it is desired to remove the section.

Figure 9:
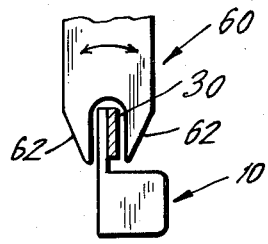
FIG. 9 schematically illustrates the manner in which a knockout tool can be used to break away the frangible section in the header of FIGS. 5 and 6.

A simple tool can be used to remove the frangible section. For example, FIG. 9 shows, in end view, a fork-shaped tool 60 having tines 61 and 62 which fit over the rib 30 and the frangible section containing the rib 30. The tool will have a width less than the width of the frangible section between the sides of the U-shaped groove 50. The tool 60 is rocked back and forth until the rib is broken out of the back wall 20 of the header 10.

By forming the polarizing ribs integrally with the back wall 20 of the header, it is impossible to accidentally lose, misplace or dislocate a polarizing rib. However, the ribs may broken away from the header wall 20 by an intentional act so that the header can be used with unpolarized sockets. Furthermore, the integral ribs of the invention ensure that the polarizing sections are rigid and of the same material as the molded header body which has the desired physical characteristics of flexibility, durability, flame retardancy, chemical resistivity and other desired characteristics.

Many header and socket configurations other than those described above are known and are in common use. The frangible polarizing rib of the invention can be applied to virtually any of those header configurations, where the rib is placed in a wall which slides over a confronting socket wall during connection of the socket and header.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A polarizing structure for polarizing a cooperating multi-contact header and socket; said header comprising a first molded housing receiving a plurality of parallel extending contact pins insulated from one another; said socket comprising a second molded housing receiving a plurality of contact receiving members adapted to receive respective ones of said plurality of contact pins in plug-in connection; said first housing having an integral first wall extending therefrom which is disposed in a plane parallel to and spaced from said extending contact pins; said socket having an integral insulation side wall which is telescopically received adjacent said first wall of said first housing when said extending pins of said header are inserted into said contact receiving members of said socket; said insulation side wall of said socket having at least one extending groove which faces said first wall and is parallel to said extending pins when said socket and header are engaged; said first wall having at least one integral and frangible section carrying a protruding rib which extends parallel to said groove and which faces said groove and said contact pins and which is located in a lateral position along the length of said first housing which corresponds to the lateral position of said groove; said rib being received in said groove when said header and socket are connected to one another with a given angular rotation between said socket and said header; said frangible section being removable to enable connection of said header to a socket which does not have a groove for receiving said rib; said frangible section being defined by reduced wall thickness slots in said one wall.

2. The structure of claim 1, wherein at least two spaced frangible sections are laterally symmetrically disposed in said one wall; each of said two frangible sections containing a corresponding removable rib facing said insulation wall of said socket.

3. The structure of claim 1, wherein the bottom of said reduced wall thickness slot contains a line of perforations.

4. A multi-contact header comprising a molded housing receiving a plurality of parallel extending contact pins insulated from one another; said housing having a first integral wall extending therefrom which is disposed in a plane parallel to and spaced from said extending contact pins; said first wall having at least one integral and frangible section therein; said at least one frangible section having a rib extending from the surface thereof facing said pins and extending parallel to said pins; said rib comprising a polarizing means to enable connection of said header to a cooperating polarized socket in only one of two possible angular relationships; said at least one frangible section being removable to enable connection of said header to a socket which is not polarized by polarizing grooves.

5. The structure of claim 4, wherein said frangible section is defined by reduced wall thickness slots in said one wall.

6. The structure of claim 4, wherein at least two spaced frangible sections are disposed in said one wall; each of said two frangible sections containing a corresponding removable rib facing said parallel extending pins.

7. The structure of claim 6, wherein each of said frangible sections is defined by respective reduced wall thickness slots in said one wall.

8. The structure of claim 7, wherein each of said reduced wall thickness slots contains lines of perforations.

9. The structure of claim 1 or 5, wherein said reduced wall thickness slots consist of first and second spaced, parallel reduced thickness slots which extend from the outer edge of said first wall and are perpendicular to said first wall; and a channel extending through said first wall and communicating with the ends of said first and second slots, whereby said first and second slots and said channel define the area of said frangible section and define an opening with sharp, regular sides when said frangible section is removed from said first wall by breaking it out along said first and second slots.

* * * * *